US005820208A

United States Patent [19]

Miklinevich

[11] Patent Number: 5,820,208

[45] Date of Patent: Oct. 13, 1998

[54] FOLDABLE BENCH AND TABLE SYSTEM

[76] Inventor: Francis David Miklinevich, 209 Allen St., Waterbury, Conn. 06706

[21] Appl. No.: 706,992

[22] Filed: Sep. 3, 1996

[51] Int. Cl.[6] ..... A47B 3/14

[52] U.S. Cl. ..... 297/159.1; 297/156; 297/170; 297/158.5

[58] Field of Search ..... 297/156, 170, 297/159.1, 157.1, 158.3, 158.5, 173, 158.4

[56] References Cited

U.S. PATENT DOCUMENTS

| | | | |
|---|---|---|---|
| D. 184,151 | 12/1958 | Schneider | 297/170 X |
| 1,367,908 | 2/1921 | Karschitz | 297/159.1 X |
| 2,638,702 | 5/1953 | Holbrook | 297/156 |
| 2,982,338 | 5/1961 | Ernst | 297/156 X |
| 4,415,199 | 11/1983 | Wright | 297/158.4 |
| 4,569,555 | 2/1986 | Lehman | 297/158.4 X |
| 4,883,314 | 11/1989 | Sakong | 297/158.4 |
| 5,330,248 | 7/1994 | Smyly et al. | 297/440.1 X |

FOREIGN PATENT DOCUMENTS

| | | | |
|---|---|---|---|
| 818230 | 9/1937 | France | 297/173 |
| 1018946 | 10/1952 | France | 297/156 |
| 1050028 | 8/1953 | France | 297/156 |
| 1159387 | 2/1958 | France | 297/156 |
| 617014 | 1/1949 | United Kingdom | 297/170 |

*Primary Examiner*—Peter M. Cuomo
*Assistant Examiner*—David E. Allred
*Attorney, Agent, or Firm*—Our Pal R Asija

[57] ABSTRACT

This invention relates to children's furniture. More particularly it relates to a collapsible integrated combination bench and table for kids for use almost anywhere. It is multipurpose quickly foldable aesthetic and stable piece of furniture which comprises a bench unit and a table unit interconnected by a common foldable member. The unit is easy to setup, fold and store.

3 Claims, 4 Drawing Sheets

FOLDABLE BENCH AND TABLE SYSTEM

BACKGROUND OF THE INVENTION

1. Field of the Invention

This invention relates to portable compact children's furniture. More particularly it relates to an integrated combination bench and table for kids for use at home nursery, garden etc. It is multipurpose quickly collapsible aesthetic and stable piece of furniture.

2. Description of the Prior Art

A preliminary prior art search was conducted. Furthermore the inventor is intimately familiar with the prior art. Following are typical examples of the prior art known to the inventor or his attorney arranged in the reverse chronological order.

a) U.S. Utility Pat. No. 4,960,303 awarded to Melvia York on Oct. 2, 1990 for "Folding Table and Seat Assembly"

b) U.S. Utility Pat. No. 4,645,261 granted to Bourne et al on Feb. 24, 1987 for "Child's Convertible Furniture"

c) U.S. Utility Pat. No. 4,289,350 bestowed upon Thomas et al on Sep. 15, 1981 for "Combined Folding Table and Seat"

d) U.S. Pat. No. 4,230,362 honorably given to Euwema et al on Oct. 28, 1980 for "Child's Table Seat"

e) U.S. Utility Pat. No. 4,070,057 earned by William Jones on Jan. 24, 1978 for "Combined Folding Table and Seat Assembly"

None of the prior art devices singly or even in combination meet all of the objectives established by the inventor for this invention.

OBJECTIVES

1. It is an objective of this invention to provide an improved self contained compact children's furniture.

2. Another objective of this invention is to provide a portable integrated combination bench and table for use almost anywhere including home office den garden etc.

3. Another objective of this invention is to provide an aesthetic furniture with multiple uses and purposes.

4. Another objective of this invention is that the furniture of this invention be safe, stable and reliable.

5. Another objective of this invention is to provide a furniture that is easy to set up, easy to fold and easy to store.

6. Another objective of this invention is that it be easily adaptable for other uses.

7. Another objective of this invention is that it be ergonomically designed, environmentally friendly and aesthetically integrated.

8. Another objective of this invention is that it is easily serviceable.

9. Another objective of this system is that the children cannot accidentally destroy or even damage it.

10. Another objective of this invention is that it provides versatility and variety in functionality under varying circumstances and weather conditions.

11. Another objective of this invention is that it meet all federal, state, local and other private standards and regulations with respect to safety, environment, energy consumption, noise etc. etc.

12. Another objective of this invention is that it obviate waste of any type.

13. Another objective of this invention is that it not interfere with normal functions of the user.

14. Another objective of this invention is that it be adaptable for other primary and secondary uses without significant modifications.

15. Another objective of this invention is that it can be adapted for used by physically challenged users.

Other objectives of this invention reside in its simplicity, elegance of design, ease of manufacture, service and use and even aesthetics as will become apparent from the following brief description of the drawing and detailed description of the best mode embodiment.

SUMMARY OF THE INVENTION

This invention relates to children's furniture. More particularly it relates to an integrated combination bench and table for kids for use almost anywhere. It is multipurpose quickly collapsible aesthetic and stable piece of furniture which comprises a bench unit and a table unit interconnected by a common foldable member. The inventor intends to use the trademark name of BENTA for this invention. The bench and table unit are each collapsible.

BRIEF DESCRIPTION OF THE DRAWING

The objects, features and advantages of the present invention and its application will be more readily appreciated when read in conjunction with the accompanying drawing, in which.

a)

b)

c)

d)

e)

f)

g)

h)

i)

DETAILED DESCRIPTION OF THE BEST MODE EMBODIMENT

Figure 1:
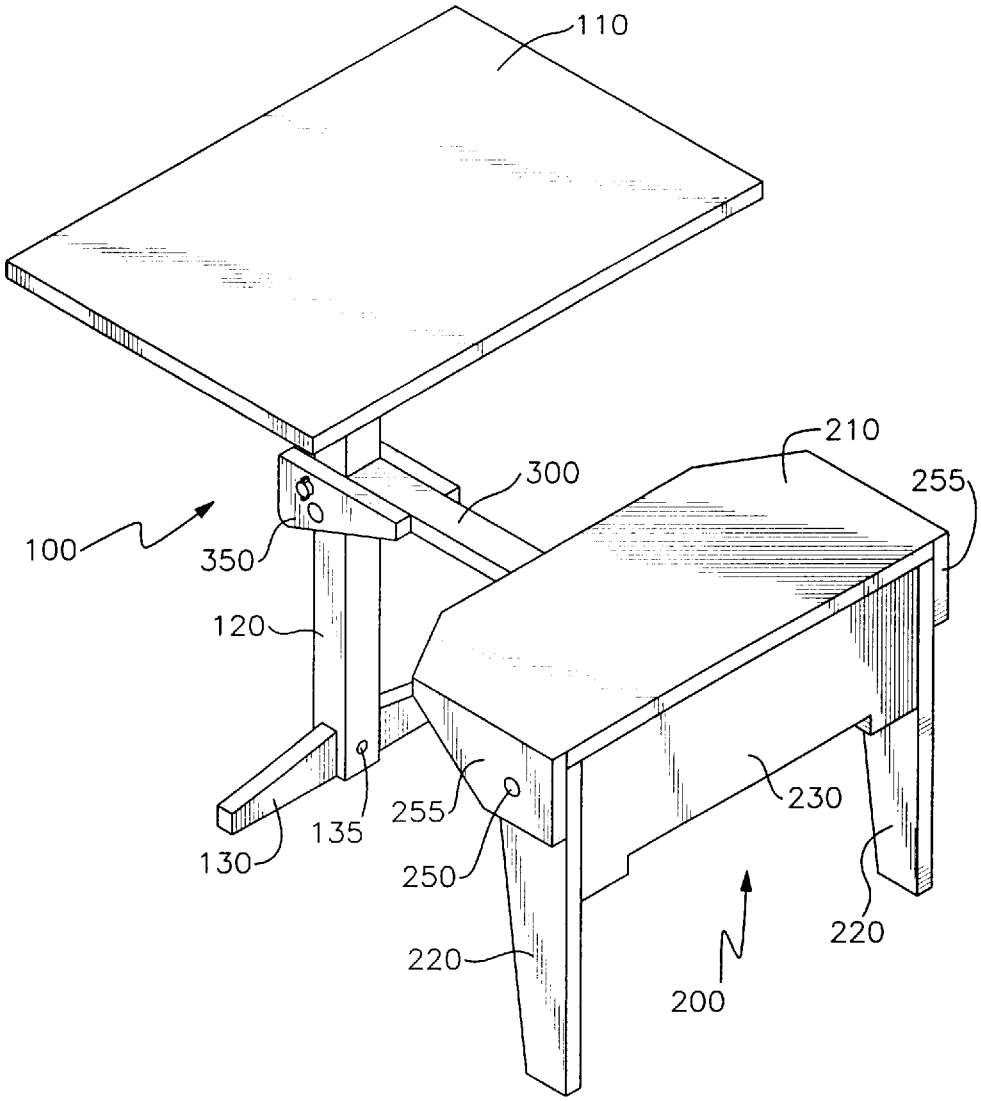
FIG. 1 is a perspective view of multi-purpose collapsible integrated bench and table system of this invention comprising a bench unit, a table unit and an interconnecting member.

As shown in the drawings wherein like numerals represent like parts throughout the several views, there is generally shown a foldable table unit 100, a foldable bench unit 200 joined by another foldable member 300.

Each foldable interface has a fulcrum and a lock release pin member. In addition to the 3 fulcrums associated with three foldable interfaces, there is a fourth fulcrum 135 associated with the foot 130 to vertical support member 120, which in turn supports the table 100. This 4th foot fulcrum stability of the unit even on somewhat uneven floor. For clarity and convenience of the reader the four fulcrums are enumerated below.

a) Table top folding fulcrum 152 b) A pair of bench folding fulcrums 252 along the same axis acting as a single fulcrum along a common axis c) Bench/Table Folding fulcrum 352 d) Table foot fulcrum

It should be noted that there is no quick latch release pin member associated with the table foot fulcrum.

The table unit 100 comprises a table top 110, a vertical support member 120 and a pivot-able base leg member 130. The vertical support member 120 is connected to said table top via folding interface 150. Optionally a table top extension member 112 is used to facilitate connection of table folding interface 150 to underside of table top 110, so as not to weaken said table top. The folding table interface 150 has a fulcrum 152 and a quick latch/release pin member 154 and a pilot hole 156 which is visible only in folded position of FIG. 9.

Figure 9:
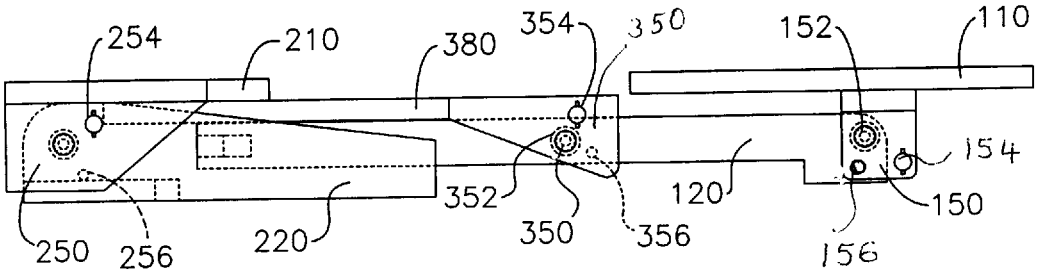
FIG. 9 is side view of the invention of FIG. 8 in collapsed position.

The bench unit 200 comprises a seat 210, a pair of folding legs 220, leg support member 230 and a pair of bench folding interfaces 250 each comprising a fulcrum 252, a quick latch/release pin member 254 a side support member 255 and a pilot hole 256 visible only in folded position of FIG. 9

The table unit 100 and bench unit 200 are interconnected by member 300 which has a foldable interface 350 to table unit 100 via its vertical support member 120. The bench table interface unit comprises a fulcrum 352 and a quick latch release pin member 354 and a pilot hole 356 visible only in folded position of FIG. 9.

Figure 2:
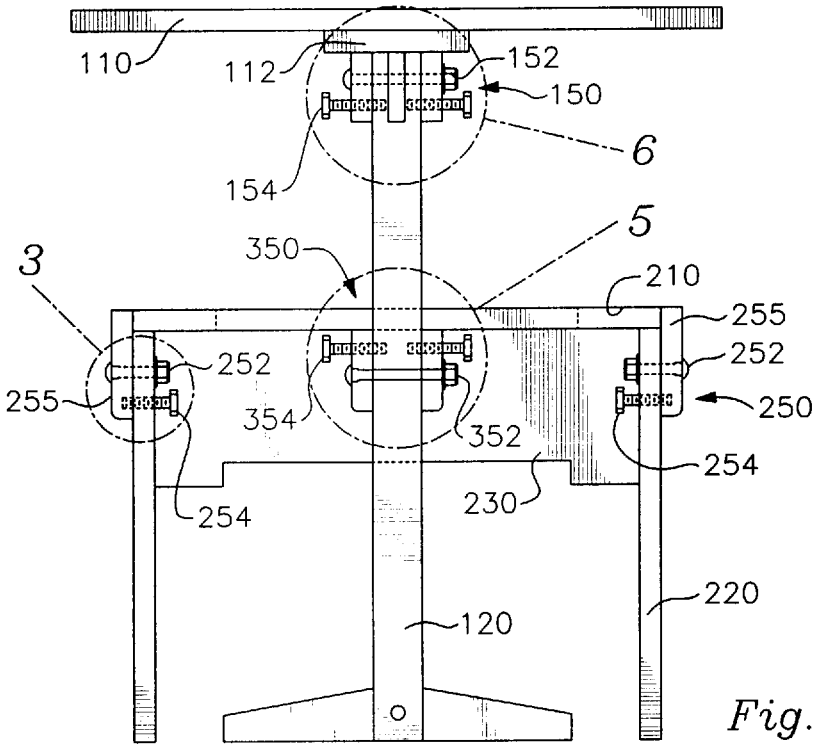
FIG. 2 is a front elevation thereof.

FIG. 2 shows front view of the foldable bench table system of this invention when viewed from the table side.

Figure 3:
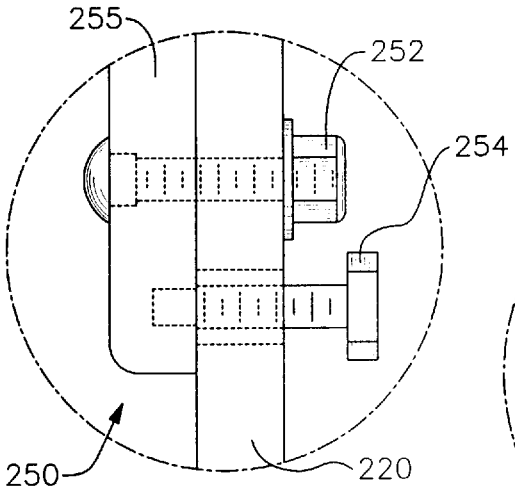
FIG. 3 is a close up view of circular section marked 3 in FIG. 2.

FIG. 3 shows a close up view of the bench folding interface 250 shown in circular section marked 3 in FIG. 2 with quick latch/release pin member in closed or locked position.

Figure 4:
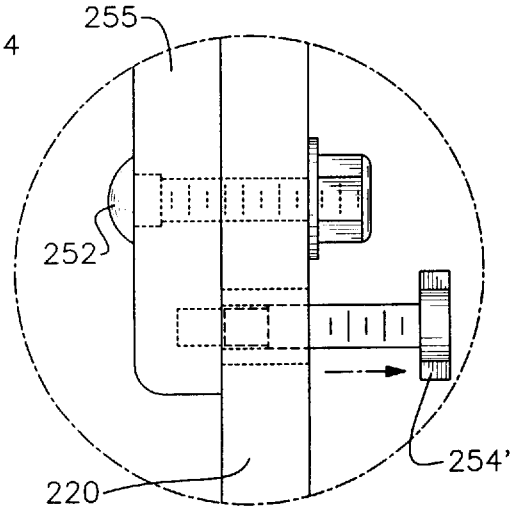
FIG. 4 is also a close up view of section marked 3 in FIG. 2 but with lock pin in extended or release position.

FIG. 4 shows a close up view of the bench folding interface 250 shown in circular section marked 3 in FIG. 2 with quick latch/release pin member in open or unlocked or release position.

Figure 5:
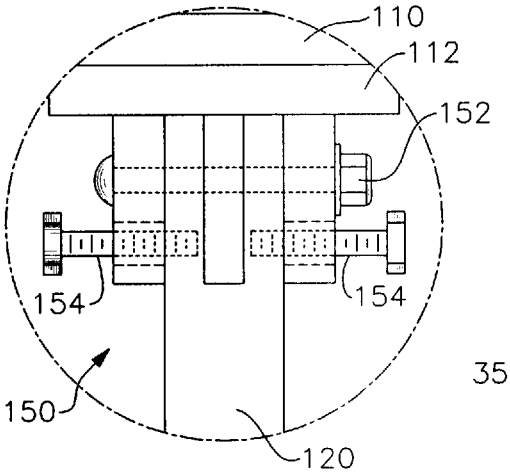
FIG. 5 is close up view of circular section marked 5 in FIG. 2.

FIG. 5 shows a close up view of the table folding interface circular 150 shown as section marked 5 in FIG. 2 which includes fulcrum 152 and quick latch release pin member 154

Figure 6:
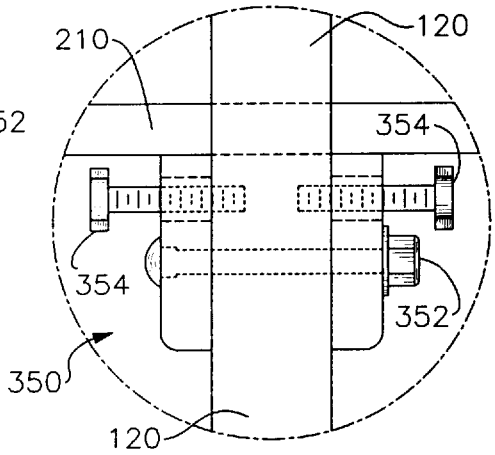
FIG. 6 is a close up view of circular section marked 6 in FIG. 2.

FIG. 6 is a close up view of bench table foldable interface 350 shown in circular section marked 6 in FIG. 2, which includes a fulcrum 352 and quick latch release pin member 354.

Figure 7:
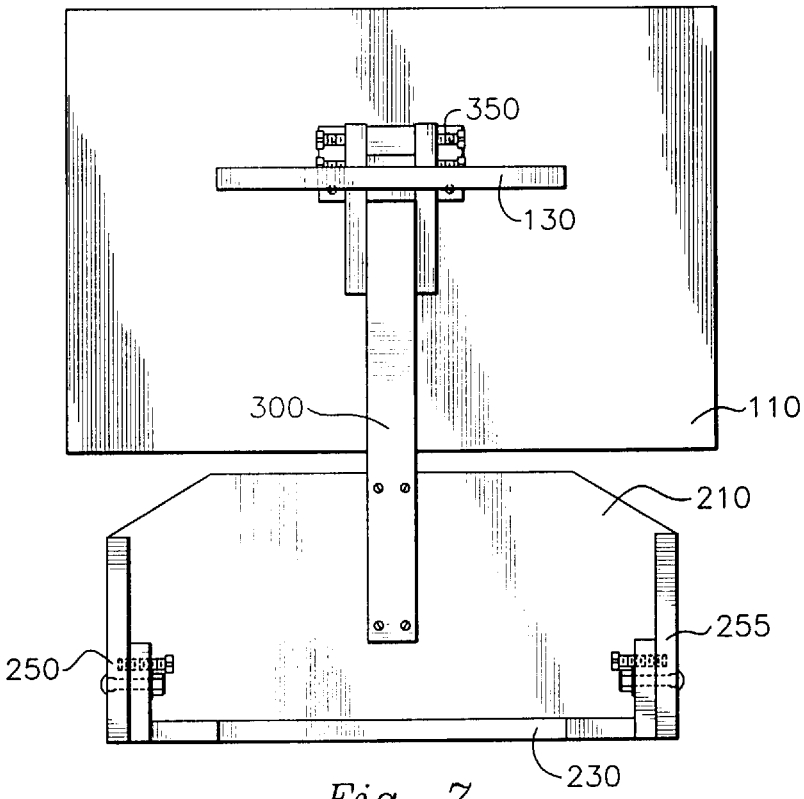
FIG. 7 is a bottom plan view.

FIG. 7 shows a bottom plan view.

Figure 8:
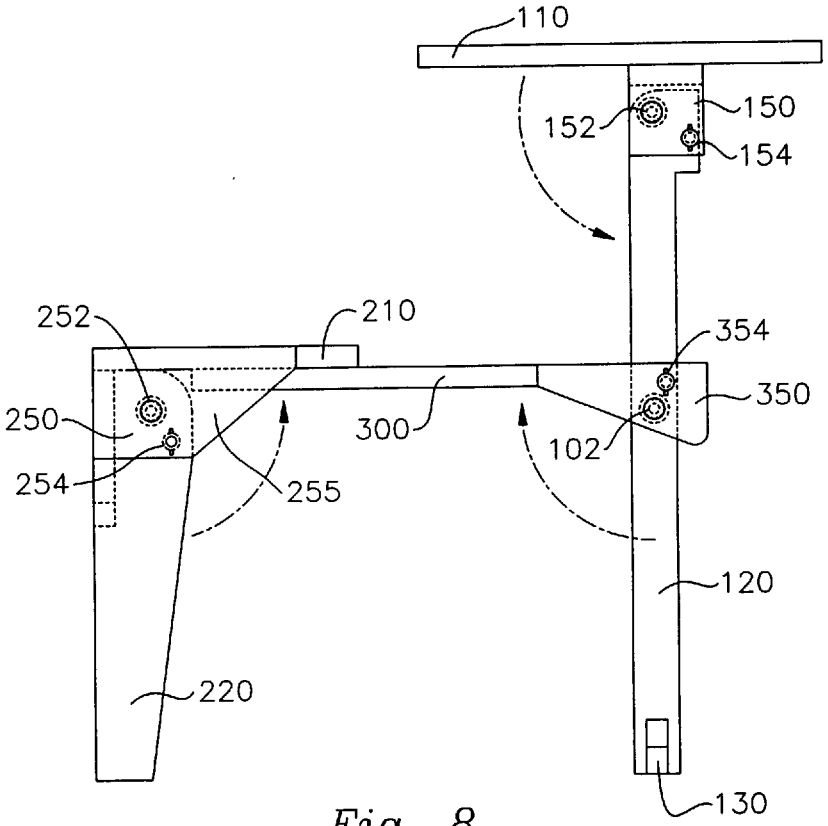
FIG. 8 is a side view.

FIG. 8 shows a side view in unfolded position.

FIG. 9 is side view of the invention of FIG. 8 in collapsed position.

All foldable interfaces can be folded by pulling quick latch release pin member out and pushing on the foldable member in the direction shown in FIG. 8. In the folded position generally magnetic or mechanical latches are employed to prevent accidental opening.

OPERATION

The operation of the BENTA(TM) is simple even intuitive. It is easy to setup fold and store. The inventor suggests the following procedure.

As shown in FIG. 8 fold all three foldable interfaces by pulling out momentarily quick latch/release pin members outwardly and then fold the respective foldable panel members in the direction shown, until it is fully folded and folding mechanical or magnetic latches (not shown) have engaged as shown in FIG. 9. The pilot holes 156, 256 & 356 associated with collapsible interfaces for table 156, bench 256 and table/bench 356 can be seen only in folded position of FIG. 9.

Store and transport as needed until needed for next use at which time the furniture can be unfolded by again pulling the corresponding elements outwardly until they snap into their respective latches.

DEFINITIONS

Great care has been taken to use words with their conventional dictionary definitions. Following definitions are included here for clarification.

DIY=Do It Yourself

Fulcrum=A point of pivot around which a body turns

Interface=Relation ship between two entities.

OEM=Original Equipment Manufacturer

The inventor has given a non-limiting description of the concept. Many changes may be made to this design without deviating from the spirit of the concept of the invention. Examples of such contemplated variations include the following.

a) The size or shape of the bench, table or other elements of this furniture may be changed.

b) The bench may be replaced by a different type of seat or chair.

c) Instead of a magnetic or mechanical latch for folded position a different kind of arrangement may be employed to prevent accidental opening of the furniture.

d) The device may be adapted for other related applications.

e) A different OEM version may be devised.

f) A small motor may be employed to facilitate folding and unfolding of the furniture.

g) Other complementary fixtures may be attached to it for example a pencil holder or a lunch compartment or the like.

h) A back support may be added to the bench unit.

i) A complimentary advertising message of the sponsor may be incorporated.

j) Casters may be added to facilitate easy strolling of the furniture.

k) Similarly brakes may be added to increase stability of the furniture during use.

Other changes such as aesthetic and substitution of newer materials as they become available which substantially perform the same function in substantially the same manner with substantially the same result without deviating from the spirit of this invention may be made.

Following is a listing of the components used in this embodiment arranged in ascending order of the reference numerals for ready reference of the reader.

100=Table unit generally

110=Table top

112=Table top extension member

120=Vertical support member

130=Pivot-able base horizontal leg member with fulcrum

135=Leg pivot fulcrum

150=Table. unit collapsible interface and fulcrum

152=Table folding fulcrum

154=Table folding latch/release pin member

156=Pilot hole for table collapsible interface

200=Bench unit generally

210=Seat of bench unit

220=Legs of bench unit

230=Bench leg support member

250=Bench unit collapsible interface and fulcrum

252=Bench folding fulcrum

254=Bench folding latch/release pin member in closed position

254'=Bench folding latch/release pin member in closed position

256=Pilot hole for bench collapsible interface

255=Bench unit side support member

300=Bench/Table interconnecting member

350=Bench/Table folding interface

352=Bench/Table Folding Fulcrum

354=Bench/Table folding Latch/Release pin member

356=Pilot hole for bench/table collapsible interface

While this invention has been described with reference to illustrative embodiments, this description is not intended to be construed in a limiting sense. Various modifications and combinations of the illustrative embodiments as well as other embodiments of the invention will be apparent to person skilled in the art upon reference to this description. It is therefore contemplated that the appended claims will cover any such modifications, embodiments as fall within the true scope of the invention.

The inventor claims:

1. A three legged portable folding bench and table system comprising:

a) a folding table unit;

b) a folding bench unit; and c) an interconnecting bench and table member connected between said folding table unit and said folding bench unit; and wherein said table unit comprises:

d) a table top;

e) a single vertical support member connected at a first end thereof to said table top;

f) a pivot able foot support member connected to said vertical support member at a second end thereof; and g) a folding interface means connected between said table top and said single vertical support member for enabling folding of said table top; and wherein said bench unit comprises:

h) a seat;

i) a pair of foldable legs connected to said seat; and said interconnecting member fixed to said seat; and j) a pair of folding interface means connected between said seat and said pair of legs for enabling folding of said legs;

k) said folding interface means comprises a table folding interface connected to said table unit;

l) said pair of folding interface means comprises a pair of bench folding interfaces along a common axis connected to said seat; and m) an interconnecting member folding interface connected to said inter connecting member and said vertical support member of said table unit at a position intermediate said first end and said second end; and wherein each said folding interface comprises a fulcrum and a quick latch release pin member.

2. A three legged portable folding bench and table system comprising:

a) a folding table unit;

b) a folding bench unit;

c) an interconnecting bench and table member connected between said folding table unit and said folding bench unit; and wherein said table unit comprises:

d) a table top;

e) a single vertical support member connected at a first end thereof to said table top;

f) a pivot-able foot support member connected to said vertical support member at a second end thereof; and g) a folding/interface means connected between said table top and said vertical support member for enabling folding of the table top relative to the vertical support member; and wherein said bench unit comprises:

h) a seat;

i) a pair of foldable legs connected to said seat; and j) a pair of folding interface means connected between said seat and said pair of legs for enabling folding of the legs relative to the seat; and k) said interconnecting member fixed to said seat; and l) an interconnecting member folding interface means connected between said interconnecting member and said vertical support member of said table unit at a position intermediate said first end and said second end; and m) wherein further each said folding interface means comprises a fulcrum and a quick latch release pin member.

3. A three legged portable foldable bench and table furniture comprising a foldable table unit, a foldable bench unit interconnected by an interconnecting member comprising:

a) a table top;

b) a single vertical support member connected at a first end thereof to said table top;

c) a pivot able foot support member connected to said vertical support member at a second end thereof;

e) a seat;

f) a pair of foldable legs connected to said seat;

g) said interconnecting member fixed to said seat;

i) a table folding interface connected between said table top and said vertical support unit;

j) a pair of bench folding interfaces having a common fold axis, said pair of folding interfaces connected between said bench seat and said pair of legs;

k) an interconnecting member folding interface connected between said interconnecting member and said vertical support unit of said table unit at a position intermediate said first end and said second end; and l) a plurality of latches to hold said furniture in folded position.

* * * * *